United States Patent [19]

Phillips

[11] 3,977,333

[45] Aug. 31, 1976

[54] STILLAGES

[75] Inventor: John Phillips, Burry Port, Wales

[73] Assignee: British Steel Corporation, London, England

[22] Filed: June 10, 1975

[21] Appl. No.: 585,487

[30] Foreign Application Priority Data

June 12, 1974 United Kingdom ..... 26068/74

[52] U.S. Cl. ..... 108/54.1; 248/23

[51] Int. Cl.[2] ..... B65D 19/38

[58] Field of Search ..... 108/51–58; 206/386; 248/23, 172, 346; 52/632

[56] References Cited

UNITED STATES PATENTS

| | | | |
|---|---|---|---|
| 2,739,776 | 3/1956 | Terando | 108/54 |
| 2,909,350 | 10/1959 | Morris | 108/54 |
| 2,942,827 | 6/1960 | Edson | 108/54 |
| 3,066,898 | 12/1962 | Haynes | 248/23 |
| 3,094,258 | 6/1963 | Punke | 248/346 X |
| 3,107,635 | 10/1963 | Kaiser | 108/51 |
| 3,329,103 | 7/1967 | Cohen | 108/54 |
| 3,695,187 | 10/1972 | Weiss | 108/54 |

FOREIGN PATENTS OR APPLICATIONS

| | | | |
|---|---|---|---|
| 599,902 | 6/1960 | Canada | 108/54 |

*Primary Examiner*—Roy D. Frazier
*Assistant Examiner*—William E. Lyddane
*Attorney, Agent, or Firm*—Bacon & Thomas

[57] ABSTRACT

A stillage for supporting stacked sheets comprising at least four co-planar members which are arranged so as to present to the sheets a platform area of rectangular outline, together with supports which are connected to the members, adjacent members being relatively movable to each other to vary the platform dimensions in two mutually perpendicular directions.

8 Claims, 6 Drawing Figures

STILLAGES

This invention relates to a stillage for supporting stacked sheets, particularly stacked sheets of steel, such as tin plate.

It is well known that cut sheets of blackplated, tinplated and chromium plated steel are stacked on a platform or stillage which has a flat top normally of wood which is supported by a number of supports usually in the form of wooden battens or runners. The area of the platform must either by equal to or slightly less than the area of the stacked sheets lying on the platform because if the dimensions of the platform are greater than the sheet dimension, poor sheet stacking results which makes subsequent packing difficult and could also give rise to sheet damage during transportation.

At present stillages are purpose built to the dimensions required for each individual cut sheet. The disadvantage of the present practice is that it is necessary to obtain and stock stillages for the possible hundreds of cut sizes of sheet which may be produced and obviously it is undesirable to utilise much needed space to store these stillages rather than utilising it for other purposes. It is therefore an object of the present invention to provide a stillage which overcomes the above disadvantage.

According to one aspect of the present invention a stillage for supporting stacked sheets comprises at least four co-planar members which are arranged so as to present to the sheets a platform area of rectangular outline, together with supports which are connected to the members, adjacent members being relatively movable to each other to vary the platform dimensions in two mutually perpendicular directions.

Clearly by providing a stillage with variable platform dimensions, it is unnecessary to make new stillages for every new sheet size as is the present practice.

Preferably the members are connected to the supports in a manner permitting the adjacent members to be movable independently of the supports in one of the directions. Suitably the supports have portions which are relatively movable to and interengage with suitably aligned corresponding portions of adjacent supports to enable the members to be movable with the supports in the other of the directions.

Preferably, means are provided to restrict the overall relative movement of the members. Suitably the means comprise at least one slot and at least one pin slidable along the length of the slot, movement of each member being restricted to the length of the slot. The interengaging portions of the supports may comprise a bore in one support for slidably receiving a piece extending from an adjacent support.

Conveniently each member and one of its adjacent members have adjacent portions shaped so as to rest upon a support common to both members, the members being respectively movable relative to the support. In this case the shaped portions may assist guidance of the members during relative movement.

An embodiment of the invention will now be particularly described with reference to the accompanying drawings in which.

Figure 1:
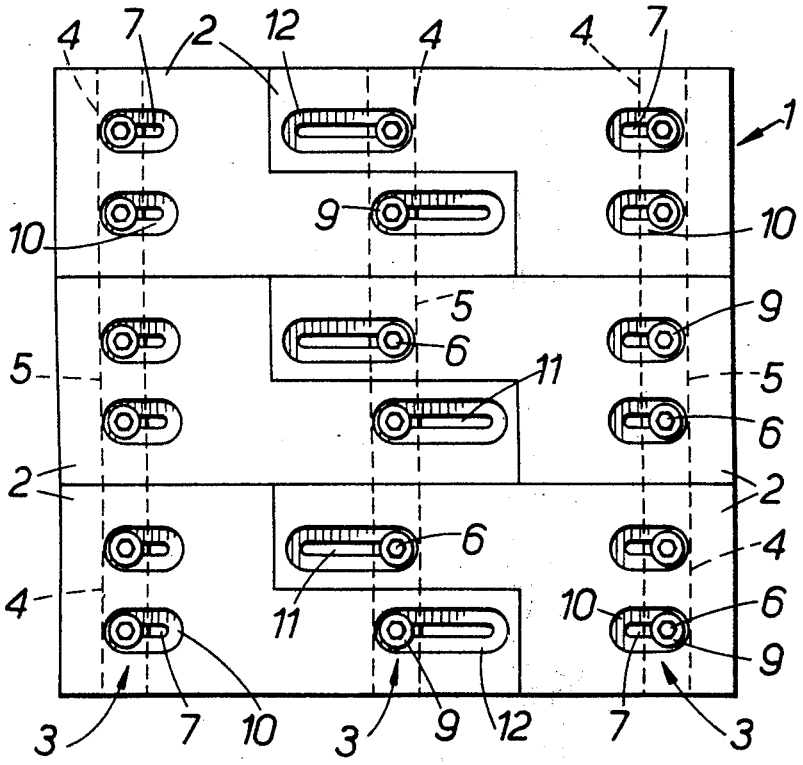
FIG. 1 is a plan view of the stillage.
Figure 2:
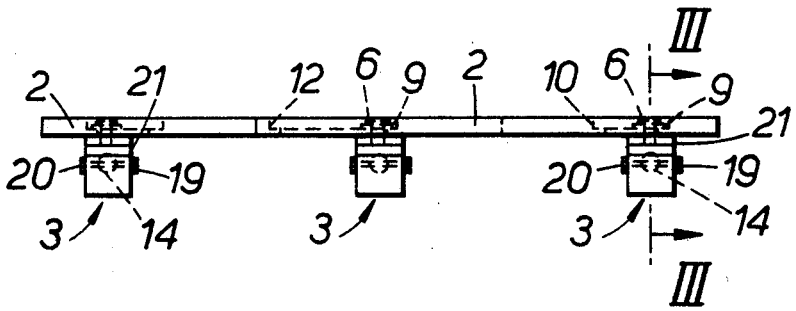
FIG. 2 is a front view of the stillage.
Figure 3:
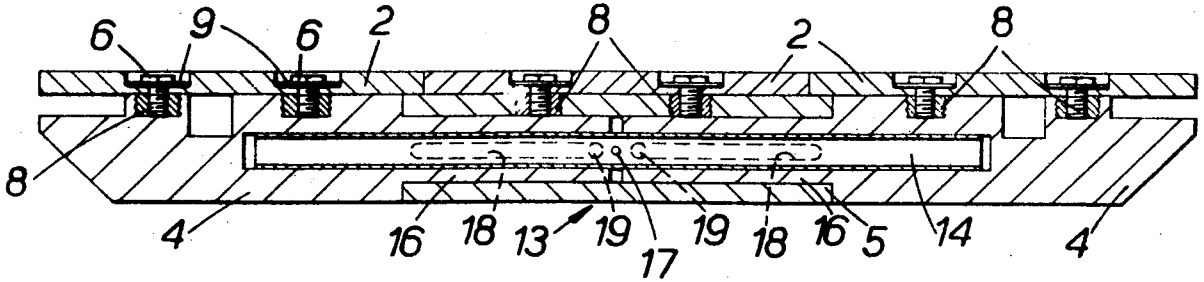
Figure 4:
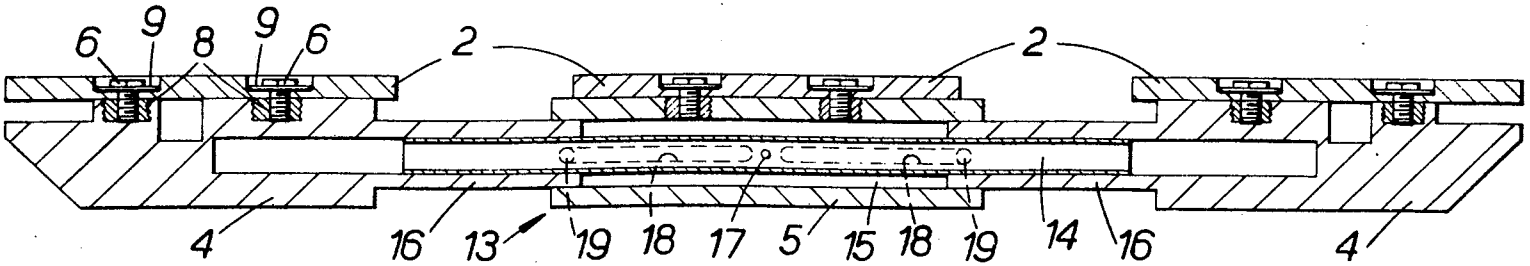
Figure 5:
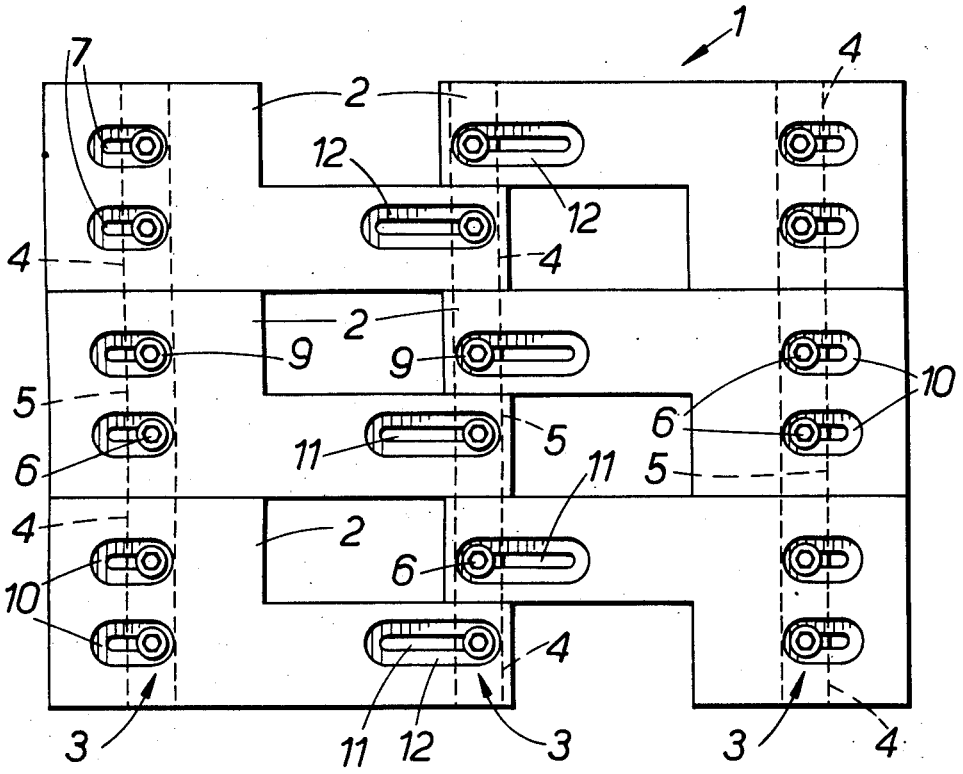
Figure 6:
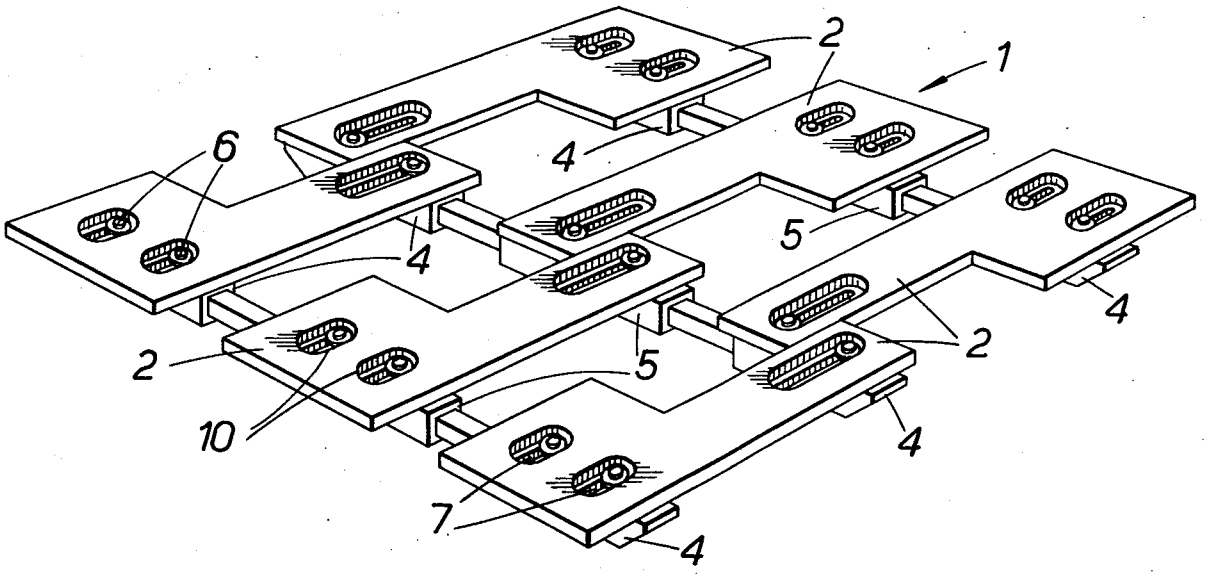

FIG. 3 is a side view of the stillage substantially in section along the line III — III of FIG. 2, FIG. 4 is a further view of FIG. 3 showing the platform area of the stillage increased in one direction, FIG. 5 is a further view of FIG. 1 showing the platform area of the stillage increased in a direction mutually perpendicular to the direction of FIG. 4 and FIG. 6 is an elevational perspective view of the stillage showing the platform area of the stillage extended the maximum amount in both directions.

Referring to the drawings, where identical parts bear the same reference numerals, FIG. 1 shows a stillage comprising a rectangular platform area indicated generally by 1 and consisting of six identically shaped planar members 2. These members 2 may be of wood, plastic, or any other suitable material.

The platform 1 is divided into three transverse rectangular sections, the outer transverse sections being relatively movable to the central transverse section so as to vary the dimensions of the platform as shown in FIG. 4 in a longitudinal direction. The platform 1 is also divided into two irregularly shaped longitudinal sections. These are also relatively movable to each other so as to extend the area of the platform 1 in a transverse direction as shown in FIG. 5.

The platform 1 is also provided with three sets 3 of three interengaging supports 4, 5 shown in hidden detail in FIG. 1 and in greater detail in FIGS. 2, 3 and 4. The three sets 3 each extend in a direction longitudinally of platform 1. Two sets 3 are located adjacent either longitudinal side of platform 1 and the third set 3 is located centrally between the two outer sets 3. The sets 3 each consist of supports 4, 5 in the form of wooden runner blocks which support the members 2. Each set 3 has two outer blocks 4 which are identical and a central runner block 5. Runner blocks 4 are connected to the members 2 forming the outer transverse sections and runner blocks 5 are connected to the members 2 in the central transverse section.

Each transverse section consists of two members 2 which are of approximately L shape. In this case the upper portion of each L is arranged to face oppositely to the adjacent upper portion of another L so that each transverse member defines a rectangular area. On the other hand each longitudinal section consists of three members arranged so that adjacent lower L portions face in the same direction. Each member 2 is connected at two positions in its lower L portion to a runner block of the outer support sets 3. The connection is effected by way of a screw threaded bolt 6 extending through a slot 7 in the members 2, the bolt screw portion 8 being located in a corresponding screw threaded bore in the runner block as shown in FIGS. 4 and 5. Each bolt 6 is provided with a washer 9 which is located between the bolt head and the member 2 within a recessed portion 10 of the surface of the member 2. The recessed portion 10 circumvents the slot 7 as also shown in hidden detail in FIG. 2. Referring to FIG. 1, each member 2 is also connected at one position in its upper L portion to a runner block of the central support set 3. In this case the respective runner block forms a common support for two members 2 of each transverse section. The connection between the members 2 and the runner block is effected in the same way as described above. The slots 11 are however in this case longer than the slots 7 and accordingly the surface recesses 12 circumventing the slot 11 are also longer.

The means for restricting the movement of the members 2 in a transverse direction are provided by the bolt 6 and the slot 7 or 11. In this case the bolts 6 are loosened from tight contact with the washers 9 so that the members 2 can be freely moved over the runner blocks 4 and 5 with the bolt 6 sliding along the slot 7 or 11. When the transverse displacement is deemed sufficient the bolts 6 can be tightened against the washers 9. The total displacement in the transverse direction is controlled by the lengths of the slots 7 and 11 as can be seen from FIG. 5.

Referring to FIGS. 3 and 4 the means for restricting movement of the members 2 in a longitudinal direction are indicated generally by the assembly 13. The assembly 13 comprises a tubular member 14 retained within a longitudinal sleeve which in this case is constituted by a bore 15 in runner block 5. The assembly 13 also comprises two extension pieces 16 which also act as sleeves for tubular member 14. The extension pieces 16 and the bore 15 constitute interengaging portions of the supports 4, 5. Each extension piece 16 projects outwardly from and is integral with each runner block 4. Each end of the tubular member 14 projects beyond the end of the runner block 5 and is slidably received within the extension piece 16 of the runner blocks 4. Extension piece 16 is a snug fit into bore 15 and tubular member 14 is a snug fit into the extension piece 16 of the blocks 4. This manner of fitting allows slidable movement and also guides the movable parts during such movement. The tubular member 14 is bolted at its centre point via two facing holes 17 (only one shown in FIGS. 3 and 4) to the runner block 5. The runner block 5 is provided with two elongated slots 18 and bolt pins 19 extend through each slot 18 and through a suitable aperture (not shown) in the extension piece 16 so that the bolt shank tip can be screwed into and out of contact with the tubular member 14. The bolt pins 19 can thus be used to lock blocks 4 in position after the blocks 4 have been moved relative to block 5. Slots 18 also serve to restrict the degree of longitudinal movement of the extension pieces 16 to the length of the slots 18.

In FIG. 3 the platform 1 is shown with no longitudinal displacement and in FIG. 4 with the maximum longitudinal displacement. In this latter case the bolt pins 19 have been moved to the further ends of the slots 18.

FIG. 6 shows the platform 1 with the members 2 moved the maximum possible transverse and longitudinal distances relative to each other.

We claim:

1. An adjustable stillage for supporting stacked metal sheets, comprising: at least four relatively movable, irregularly shaped members having substantially coplanar load bearing surfaces and movable to abut and form a substantially unbroken, rectangular, load bearing, minimum, platform area comprised of two transverse rectangular sections; each of said sections formed by two of said irregularly shaped members, a central elongate support means and two outside elongate support means aligned in the same direction and disposed below said members, said central support means being attached to all of said members and said outside support means each being attached to at least two of said members permitting the members to be relatively movable to each other to a limited extent to vary the platform area in two mutually perpendicular directions.

2. An adjustable stillage according to claim 1 in which one member of each of said transverse sections has a portion shaped to interlock upon abutment with a corresponding portion of the other member of the respective transverse section, each member being movable to separate the corresponding interlocked portions and increase the load bearing area, whereby the load bearing area is distributed in a uniform manner.

3. An adjustable stillage according to claim 2 in which each member is attached to at least two of said supports means, and the members are movable transversely of said central support means to vary the load bearing area in a transverse direction.

4. An adjustable stillage according to claim 3 in which each member is movable transversely of the associated outside support means.

5. An adjustable stillage according to claim 3 in which each of said support means comprises at least two interengagable and relatively movable support members, the members being movable with the support members to vary the load bearing area in a longitudinal direction.

6. An adjustable stillage according to claim 3 in which fastening means is provided for adjustably attaching the members to the central support means.

7. An adjustable stillage according to claim 4 in which fastening means is provided for adjustably attaching the members to the associated outside support means.

8. An adjustable stillage according to claim 1 in which the support means are movable transversely to a limited extent relative to each other, the members being movable with the supports in a transverse direction.

* * * * *